US012474049B2

(12) United States Patent
Safar et al.

(10) Patent No.: US 12,474,049 B2
(45) Date of Patent: Nov. 18, 2025

(54) AUTOMATICALLY IGNITING GAS FLARES

(71) Applicant: Saudi Arabian Oil Company, Dhahran (SA)

(72) Inventors: Anas H. Safar, Dhahran (SA); Abdulaziz H. Altijani, Al Khobar (SA); Mohammed A. Almubayedh, Dhahran (SA); Rashid O. Al-Rashidi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 427 days.

(21) Appl. No.: 18/089,035

(22) Filed: Dec. 27, 2022

(65) Prior Publication Data

US 2024/0210033 A1 Jun. 27, 2024

(51) Int. Cl.

| | |
|---|---|
| ***F23Q 1/02*** | (2006.01) |
| ***F01D 15/00*** | (2006.01) |
| *F23G 7/08* | (2006.01) |

(52) U.S. Cl.

CPC ..... *F23Q 1/02* (2013.01); *F01D 15/00* (2013.01); *F23G 7/08* (2013.01)

(58) Field of Classification Search

CPC . F23Q 9/045; F23Q 2/285; F23Q 1/02; F01D 15/00; F23G 7/08; F23D 2207/00

See application file for complete search history.

(56) References Cited

U.S. PATENT DOCUMENTS

| | | | |
|---|---|---|---|
| 3,583,851 | A | 6/1971 | Harrington et al. |
| 4,202,168 | A | 5/1980 | Acheson et al. |
| 4,505,668 | A | 3/1985 | DiBiano et al. |
| 4,604,047 | A | 8/1986 | Coulthard |
| 8,390,981 | B1 | 3/2013 | Treadaway et al. |
| 8,967,995 | B1 | 3/2015 | Griffin et al. |
| 10,029,291 | B2 | 7/2018 | Fischer et al. |
| 11,187,409 | B2 | 11/2021 | Soliman et al. |
| 2003/0069743 | A1 | 4/2003 | Nordrum |
| 2010/0070404 | A1 | 3/2010 | McConnell |
| 2014/0266740 | A1 | 9/2014 | Fernandes et al. |
| 2015/0037739 | A1 | 2/2015 | Hall |
| 2015/0260397 | A1 | 9/2015 | Talasila et al. |
| 2017/0370579 | A1 | 12/2017 | Johnson et al. |
| 2019/0242575 | A1 | 8/2019 | Fisher et al. |
| 2019/0366400 | A1 | 12/2019 | Chambers et al. |
| 2020/0386404 | A1 | 12/2020 | Kraus et al. |

(Continued)

FOREIGN PATENT DOCUMENTS

| | | |
|---|---|---|
| EP | 2309186 | 4/2011 |
| EP | 2330347 | 6/2011 |

(Continued)

OTHER PUBLICATIONS

U.S. Appl. No. 17/486,004, filed Sep. 27, 2021, Safar et al.

(Continued)

*Primary Examiner* — Alfred Basichas
(74) *Attorney, Agent, or Firm* — Fish & Richardson P.C.

(57) ABSTRACT

Systems and devices for igniting a gas to be flared include: a body having an inlet and an outlet, the body defining a channel extending between the inlet and the outlet; an igniter operable to generate a spark at the outlet of the body; an actuator disposed in the channel, the actuator configured to harvest energy when the gas to be flared flows from the inlet to the outlet through the channel and transfer the energy to the igniter.

15 Claims, 3 Drawing Sheets

(56) References Cited

U.S. PATENT DOCUMENTS

| | | | |
|---|---|---|---|
| 2021/0372864 | A1 | 12/2021 | Tao et al. |
| 2023/0096405 | A1 | 3/2023 | Safar et al. |
| 2023/0128460 | A1 | 4/2023 | Safar et al. |
| 2024/0011632 | A1 | 1/2024 | Safar et al. |

FOREIGN PATENT DOCUMENTS

| | | |
|---|---|---|
| EP | 2833065 | 2/2015 |
| MY | UI2019005335 | 1/2024 |

OTHER PUBLICATIONS bakerhughesds.com [online], "Flare gas measurement & control solutions," 2021, retrieved Aug. 9, 2021 from URL<https://www.bakerhughesds.com/panametrics/flare-management>, 11 pages.
Boneu et al., "How and when to monitor a patient treated with low molecular weight Heparin," Seminars in Thrombosis and Hemostasis, Oct. 2001, 27(5):519-522, 4 pages.
Compendium of Greenhouse Gas Emissions Methodologies for the Oil and Natural Gas Industry, American Petroleum Institute, Aug. 2009, 807 pages.
Eddleman et al., "Flare monitoring regulatory compliance and analyzers: An analysis," Yokogawa, 2018, 4 pages.
Engineering Data Book, The Gas Processor Suppliers Association (GPSA), 12th Edition, vol. 1, Chapter 5: Relief Systems, 2004, 25 pages.
Gilmer et al., "Draft flare waste gas flow rate and composition measurement methodologies evaluation document," Texas Commission on Environmental Quality, Work Assignment 5, Shell Global Solutions, available on or before Jun. 2013 via Internet Archive Wayback Machine URL <https://web.archive.org/web/20131101000000*/https://www.tceq.texas.gov/assets/public/implementation/air/am/contracts/reports/oth/FLARE_WASTE_GAS_FLOW_RATE.pdf>, 141 pages.
Hankinson et al., "Ignition Energy and Ignition Probability of Methane-Hydrogen—Air Mixtures," International Conference on Hydrogen Safety, Sep. 2009, 12 pages.
Mandatory Greenhouse Gas Reporting, 40 CFR § 98, Chapter I, Subchapter C, Oct. 2009, 581 pages.
Moorman et al., "Lower heating value sensor for fuel monitoring," IEEE Sensors, 2005, 802-805, 4 pages.
pontiacpower.org [online], "HEI/High Energy Ignition," available on or before Nov. 28, 2010, via Internet Archive: Wayback Machine URL <https://web.archive.org/web/20101128050345/http://www.pontiacpower.org/HEI.pdf>, retrieved on Mar. 25, 2024, URL <http://www.pontiacpower.org/HEI.pdf>, 16 pages.
sciencedirect.com [online], "Flare Tip," 2016, retrieved on Mar. 25, 2024, retrieved from URL <https://www.sciencedirect.com/topics/engineering/flare-tip>, 9 pages.
sciencedirect.com [online], "Minimum Energy for Ignition," 2022, retrieved on Mar. 25, 2024, retrieved from URL <https://www.sciencedirect.com/topics/engineering/minimum-energy-for-ignition>, 10 pages.
Sick, "Flowsic100 Flare: Reliable gas flow measurement in flare gas applications," Oct. 2021, retrieved Jul. 13, 2022, retrieved from URL <https://www.bakerhughesds.com/panametrics/sensors-probes-transducers-transmitters/oil-and-gas/panametrics-flare>, 5 pages.
sick.com [online], "Gas flow measuring instruments FLOWSIC100 Flare," 2021, retrieved Aug. 9, 2021 from URL<https://www.sick.com/th/en/flow-measurement-technology/gas-flow-measuring-instruments/flowsic100-flare/c/g198253>, 7 pages.
Sorrels et al., "Flares," VOC Destruction Controls, U.S Environmental Protection Agency, Aug. 2019, 71 pages.
thermofisher.com [online], "Flare stack emission monitoring," Available on or before May 4, 2021, via Internet Archive Wayback Machine URL <https://web.archive.org/web/20210420073913/https://www.thermofisher.com/us/en/home/industrial/manufacturing-processing/flare-stack-emission-monitoring.html>, retrieved on Oct. 12, 2021, retrieved from URL <https://www.thermofisher.com/sa/en/home/industrial/manufacturing-processing/flare-stack-emission-monitoring.html>, 4 pages.
Umukoro et al., "Modelling emissions from natural gas flaring," Journal of King Saud University—Engineering Sciences, 2017, 29:178-182, 5 pages.
Zeng et al., "Validation of a new method for measuring and continuously monitoring the efficiency of industrial flares," Journal of the Air & Waste Management Association, 2016, 66(1):76-86, 12 pages.
PCT International Search Report and Written Opinion in International Appln. No. PCT/US2022/077028, dated Jan. 23, 2023, 12 pages.
PCT International Search Report and Written Opinion in International Appln. No. PCT/US2022/077030, dated Jan. 30, 2023, 14 pages.
PCT International Search Report and Written Opinion in International Appln. No. PCT/US2022/078596, dated Feb. 2, 2023, 15 pages.
PCT International Search Report and Written Opinion in International Appln. No. PCT/US2023/026336, dated Oct. 10, 2023, 12 pages.
PCT International Search Report and Written Opinion in International Appln. No. PCT/US2023/084271, dated Mar. 13, 2024, 12 pages.

AUTOMATICALLY IGNITING GAS FLARES

TECHNICAL FIELD

This disclosure relates to igniting gas flares.

BACKGROUND

Gas flares are combustion devices used in places such as petroleum refineries, chemical plants and natural gas processing plants, oil or gas extraction sites. In industrial plants, gas flares can be used for burning off flammable gas released, for example, by safety valves. At oil and gas extraction sites, gas flares can be used for a variety of startup, maintenance, testing, safety, and emergency purposes and/or to dispose of large amounts of unwanted hydrocarbons (e.g., methane produced with crude oil).

SUMMARY

This specification describes an approach to automatically igniting gas flares. This approach includes mechanical devices that can be installed in a flare tip to ignite gas as the gas flows through the flare tip. These devices can be an integral part of flare tips or can be added on to existing flare tips to retrofit them. With the added devices, the flare tips can be self-ignited, for example, without additional utilities or power.

These devices can be the primary source of ignition on the flare tip or can be a secondary source of ignition that can provide redundancy in igniting the flare tip. During a flaring event, the flow of the gases to be flared drive a turbine. The turbine is connected (e.g., by a pulley) to an igniter installed inside the device. The rotation of the pulley can create a spark at the top of the flare tip. High flaring events will provide more and/or bigger sparks which increases the likelihood that the device meets the ignition requirement for the gas to be flared. By avoiding flame-off scenarios, this approach can provide additional safety measures to increase the likelihood that a flare stack is ignited when gas is flowing through the flare tip. These devices can be installed in all different types of flare systems such as Low Pressure (LP), High Pressure (HP) or Low Temperature (LT) flares.

In one aspect, a system for igniting a gas to be flared includes a body having an inlet and an outlet, the body defining a channel extending between the inlet and the outlet; an igniter operable to generate a spark at the outlet of the body; an actuator disposed in the channel, the actuator configured to harvest energy when the gas to be flared flows from the inlet to the outlet through the channel and transfer the energy to the igniter.

In one aspect, a device for igniting in a flare tip includes: a body having an inlet and an outlet, the body defining a channel extending between the inlet and the outlet; an igniter operable to generate a spark at the outlet of the body; an actuator disposed in the channel, the actuator configured to harvest energy when the gas to be flared flows from the inlet to the outlet through the channel and transfer the energy to the igniter.

Embodiments of these systems and devices can include one or more of the following features.

In some embodiments, a source of the gas to be flared is included, the source in fluid communication with the inlet of the body. In some cases, the system further includes a conduit having a flare tip, the inlet of the body in fluid communication with the conduit and positioned to receive a portion of the gas to be flared. In some cases, the outlet of the body is positioned to provide a spark or flame in the conduit.

In some embodiments, the channel of the body is a primary route through which the gas to be flared travels from the source to an outside environment.

In some embodiments, only a portion of the gas to be flared travels through the body.

In some embodiments, a flare tip is included, the flare tip incorporating the body. In some cases, the system includes a pilot ignition system.

In some embodiments, the actuator includes a turbine. In some cases, the actuator includes a first member and a second member positioned in contact with the first member such that relative motion between the first member and the second member generates sparks. In some cases, the turbine is operably coupled to the first member such that rotation of the turbine causes relative motion between the first member and the second member. In some cases, the first member includes a ferrocerium alloy and the second member includes a material harder than the first member. In some cases, the actuator further includes a shaft of the turbine connected to a first pulley, a second pulley in communication with the first pulley such that the rotation of the first pulley causes rotation of the second pulley, the second pulley connected to the first member.

The systems and methods described in this specification can provide a mechanical device that can sustain flame in the flare tip without a need for additional utilities or power. By using mechanical energy to provide ignition, this approach is more reliable than devices that are dependent on power sources that could be interrupted or malfunction. This approach can also improve operation of the flare tip by providing a redundant ignition source, for example, during high acid flaring event which may lead to a flame off scenario. For example, in a gas plant a Sulfur Recovery Unit may trip leading to a high acid flare from a Gas Treating Unit. An acid flare which mainly includes $CO_2$ and $H_2S$ can significantly drop the heating value of the gas being flared which may put out the flame. Installing an auto ignition device can increase the likelihood that the flame can reignited once the heating value of the gas being flared returns to an ignitable limit.

The details of one or more embodiments of these systems and methods are set forth in the accompanying drawings and the description below. Other features, objects, and advantages these systems and methods will be apparent from the description and drawings, and from the claims.

DETAILED DESCRIPTION

This specification describes an approach to automatically igniting gas flares. This approach includes mechanical devices that can be installed in a flare tip to ignite gas as the gas flows through the flare tip. These devices can be an integral part of flare tips or can be added on to existing flare tips to retrofit them. With the added devices, the flare tips can be self-ignited, for example, without additional utilities or power. These devices can be the primary source of ignition on the flare tip or can be a secondary source of ignition that can provide redundancy in igniting the flare tip.

Figure 1:
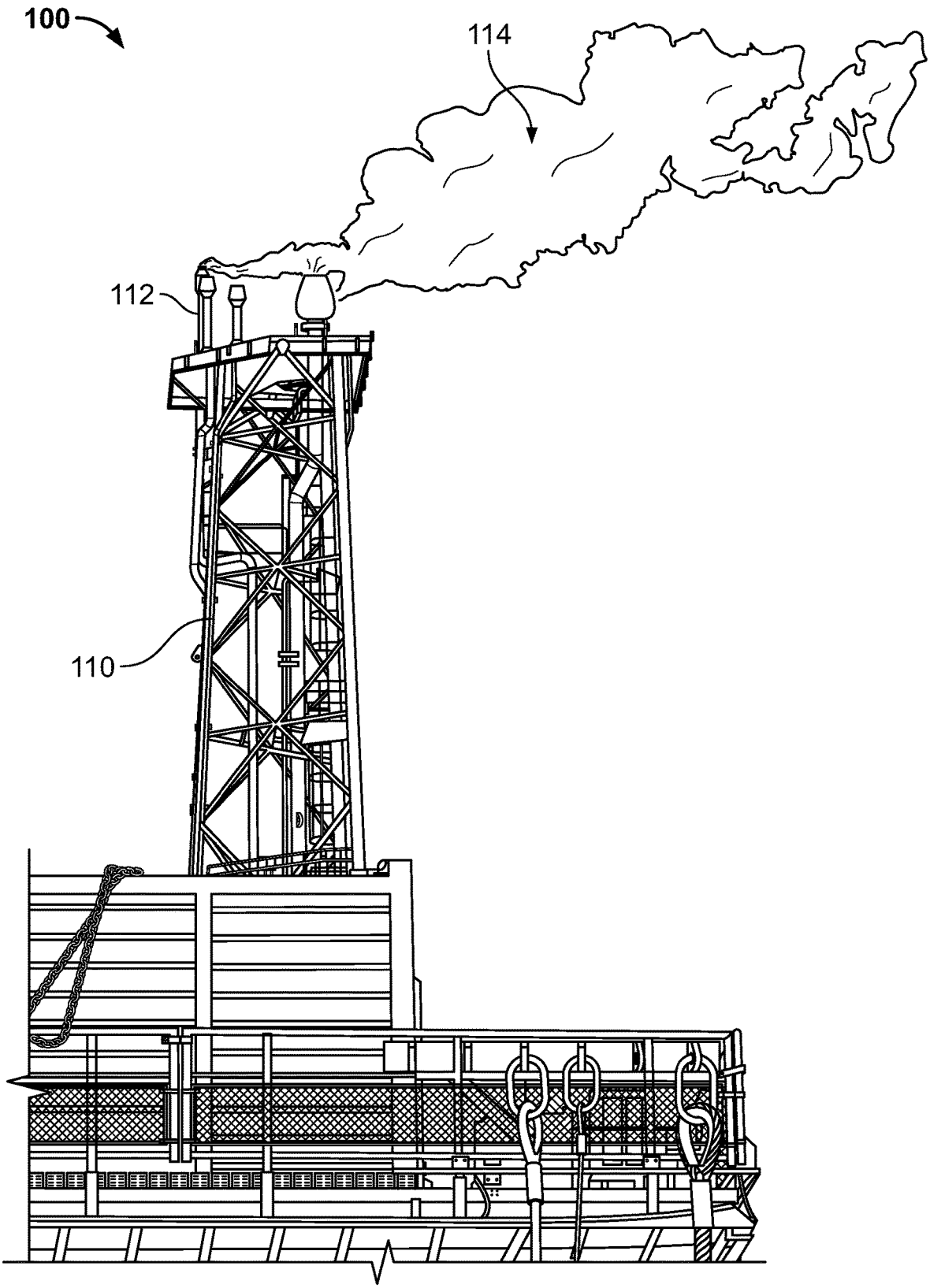
FIG. 1 is an illustration of natural gas being flared off at an oil well.

FIG. 1 is an illustration of an oil production well 100. The oil production well 100 has a well head 110 with several flare tips 112 being used to flare off waste gases 114, for example, natural gas associated with the production of crude from the oil production well 100.

Ignition is the process through which combustion is initiated and occurs when a flammable mixture of fuel and oxidizer come in contact with a suitable ignition source. The energy for ignition can be obtained from a variety of sources such as direct contact with a spark or flame, static electricity, autoignition, autooxidation, and adiabatic compression.

When the energy for ignition is supplied to the fuel-oxidizer mixture, the reactant bonds of the mixture rupture, producing intermediate species such as $CH_3$, H, O, etc. Such species are extremely reactive and recombine to form the final combustion products $CO_2$ and $H_2O$. This reaction, once started, can continue until the reactants are consumed.

The ignition energy of the gases to be flared is dependent on the composition of the gases, for example, sweet gas which mainly includes methane can have an ignition energy of 0.3 MJ while acid gas that contains hydrogen sulfide can decrease the ignition energy to 0.22 MJ. In some cases, the ignition energy of the gases to be flared can be between 0.2 to 0.35 MJ.

In some cases, during relief scenarios the velocity profile of the gases being flared at the flare tip can range from Mach 0.3 (326 ft/s) to Mach 1 (1087 ft/s). In other cases, such as routine flaring activities, the velocity profile of the gases being flared can range from 0.5 to 1 ft/s.

Flare tips can use a continuous flare pilot burner that is ignited by a flame front generator (FFG). An FFG is a device that sends a small burst of flame to the top of a flare stack, allowing the operator to ignite the pilot burner from ground level. FFG devices have been used to ignite flare pilot burners from a great distance such as 1 mile. Ignition devices should be designed for the particular equipment and the specific set of process conditions for which they will be used.

Figure 2:
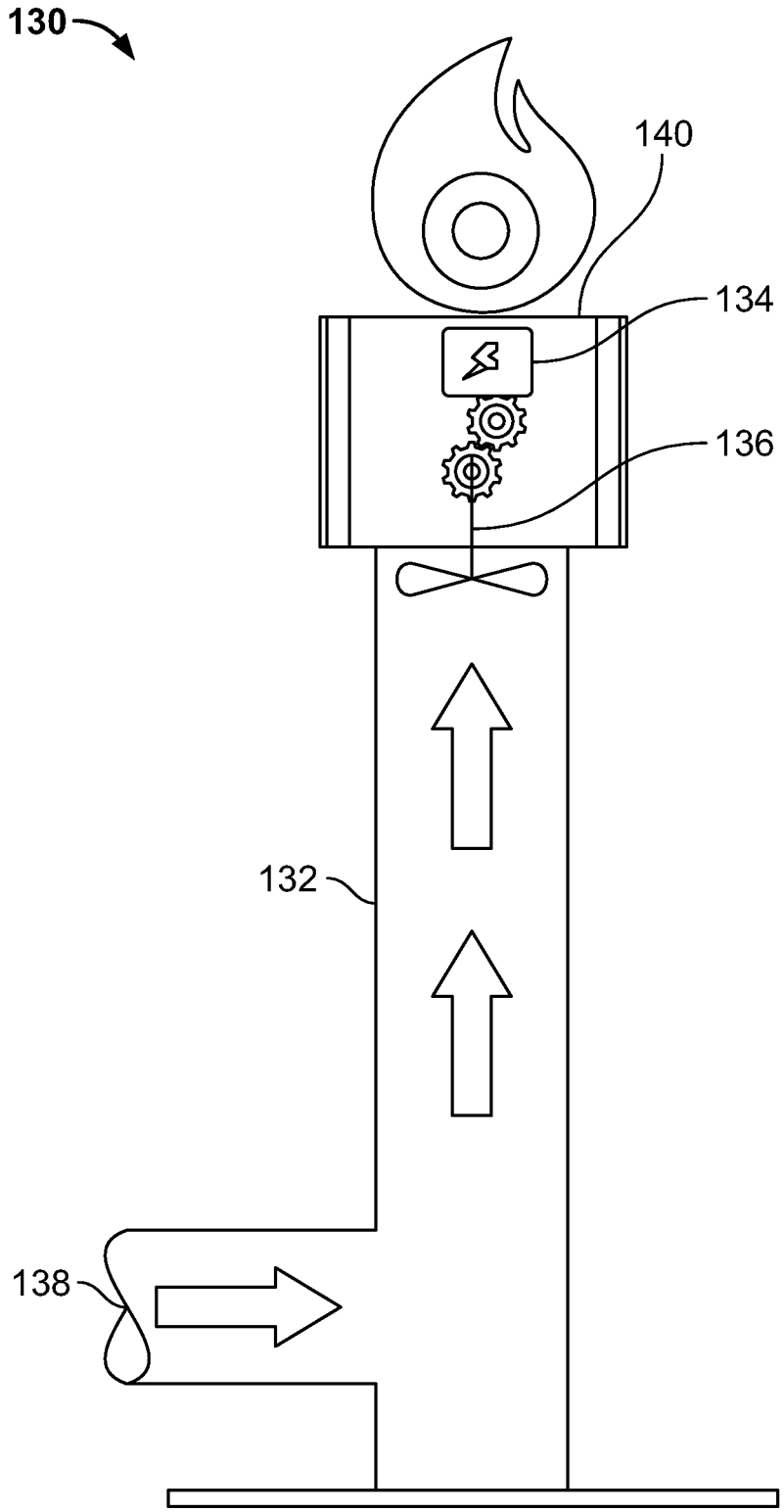
FIG. 2 is a schematic illustration of a device for igniting gas to be flared.

FIG. 2 is a schematic illustration of a device 130 for igniting gas to be flared. The device 130 includes a body 132, an igniter 134, and an actuator 136. The body 132 has an inlet 138 and an outlet 140. The body 132 defines a channel for the gases to be flared to travel from the inlet 138 to the outlet 140. A source of the gases to be flared is fluidly connected to the inlet 138. The igniter 134 is disposed at the outlet 140. The actuator 136 is disposed within the channel defined by the body 132 and is configured to harvest energy from the gas to be flared flowing through the body 132 from the inlet 138 to the outlet 140. The actuator 136 may be a turbine. The energy harvested from the actuator 136 is transferred to the igniter 134 to generate a spark. In this embodiment, the body 132 forms a primary flow path for the gases to be flared to travel from the source to the outside environment.

In some implementations, the actuator 136 is operable to harvest energy from gases being flared with velocities of the gases at the flare tip up to 1087 ft/s to generate a spark to ignite the gases being flared. In some implementations, the actuator 136 can harvest energy from gases being flared with velocities at the flare tip in the range of 0.5 ft/s to 1 ft/s.

The igniter 134 is operable to generate a spark at the outlet 140 of the body 132. The igniter 134 can be such that higher flaring events will generate larger and/or more sparks to increase the likelihood that the gases to be flared will ignite. The actuator 136 may comprise a first member and a second member in contact with the first member such that relative motion between the first member and the second member generates a spark or a plurality of sparks. If the actuator 136 is a turbine, the turbine may be operably connected to the first member such that the rotation of the turbine causes the relative motion between the first member and the second member.

In some implementations, the first member of the igniter can comprise a pyrophoric alloy such as a ferrocerium alloy. The second member of the igniter can comprised of a harder material such as steel. The relative motion between the first member that is in contact with the second member can generate sparks with temperatures up to 6000° F. This can meet the ignition energy of the gases being flared.

The body 132 may be incorporated into a flare tip. The flare tip may also comprise additional flare tip ignition devices such as a pilot burner with a flame front generator. The igniter 134 can be disposed near the top of the flare tip.

The size and material of the device 130 can be dependent on the size of the flare tip, the capacity of the flare tip, and/or the type of flare tip (e.g., low temperature or high temperature). For example, a cold flare tip can use a device 130 including a stainless steel material.

Figure 3:
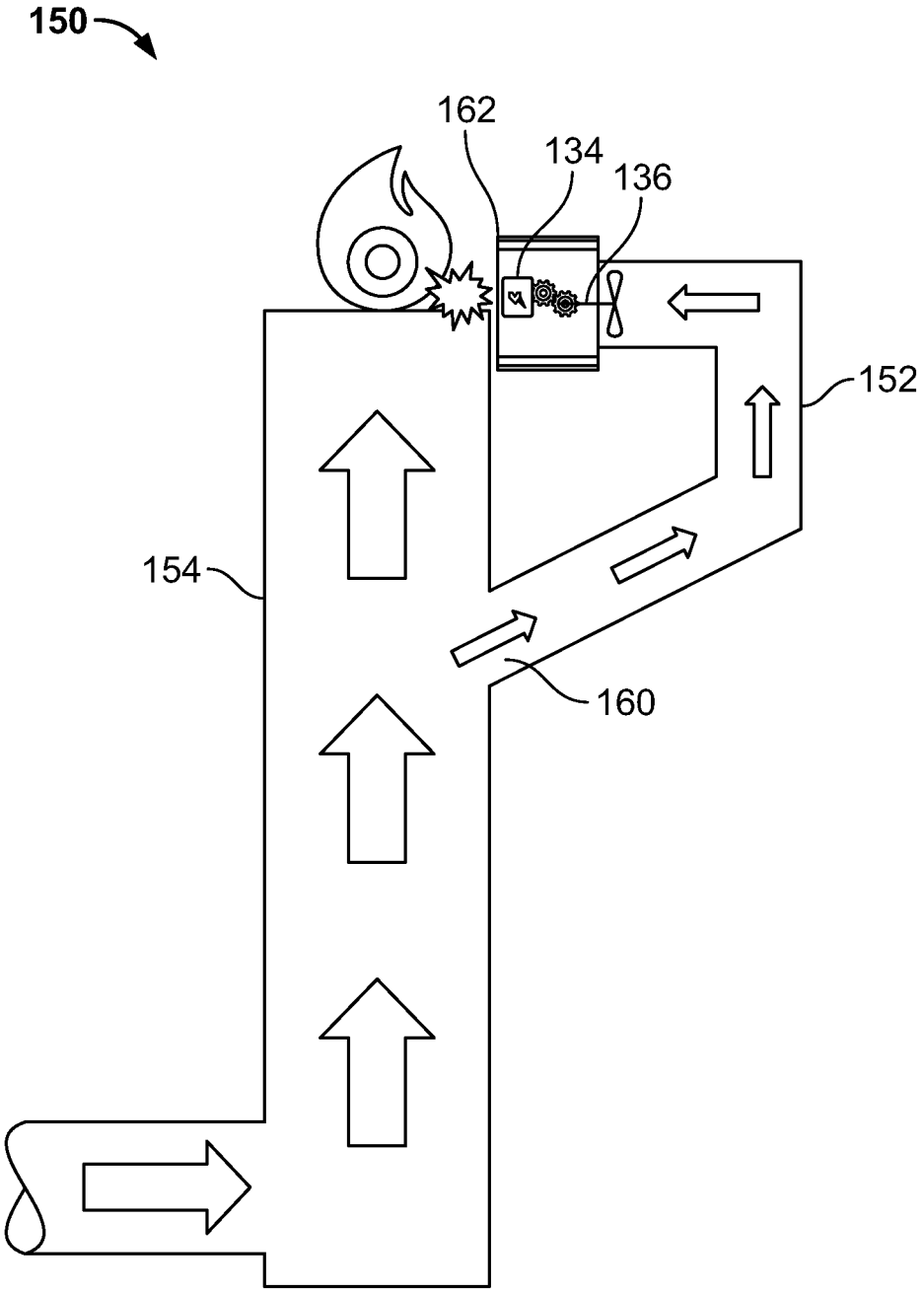
FIG. 3 is a schematic illustration of a system for igniting gas to be flared. Like reference symbols in the various drawings indicate like elements.

FIG. 3 is a schematic illustration of a system 150 for igniting gas to be flared. The system 150 comprises a body 152, a conduit 154 having a flare tip, an actuator 136, and an igniting device 134. The body 152 has an inlet 160 and an outlet 162. The body 152 defines a channel between the inlet 160 and the outlet 162 through which gases to be flared can travel. The inlet 160 is in fluid communication with the conduit 152 and positioned to receive a portion of the gases to be flared. The igniting device 134 is operable to generate a spark at the outlet 162. The outlet 162 is positioned such that the igniting device 158 can generate a spark in the conduit 154 to ignite the gases to be flared. A source of gases to be flared is in fluid communication with the conduit 154 upstream of the inlet 160.

The flare tip of the conduit 154 may comprise additional ignition devices such as a pilot ignition system or a pilot burner with a flame front generator. The igniter 134 may be a secondary or redundant device for igniting the gas to be flared.

The size and material of the system 150 can be dependent on the size of the flare tip, the capacity of the flare tip, and/or the type of flare tip (e.g., low temperature or high temperature). For example, a cold flare tip can use a device 130 including a stainless steel material.

A number of embodiments of the invention have been described. Nevertheless, it will be understood that various modifications may be made without departing from the spirit and scope of the invention. For example, a device for igniting gases to be flared can include various elements based on the expected gas composition and velocity of the gases to be flared. Accordingly, other embodiments are within the scope of the following claims.

What is claimed is:

1. A system for igniting a gas to be flared, the system comprising:

a body having an inlet and an outlet, the body defining a channel extending between the inlet and the outlet;

an igniter operable to generate a spark at the outlet of the body;

an actuator disposed in the channel, the actuator configured to harvest energy when the gas to be flared flows from the inlet to the outlet through the channel and transfer the energy to the igniter, and a flare tip, the flare tip incorporating the body.

2. The system of claim 1, further comprising a source of the gas to be flared, the source in fluid communication with the inlet of the body.

3. The system of claim 2, further comprising a conduit having a flare tip, the inlet of the body in fluid communication with the conduit and positioned to receive a portion of the gas to be flared.

4. The system of claim 3, wherein the outlet of the body is positioned to provide a spark or flame in the conduit.

5. The system of claim 2, wherein the channel of the body is a primary route through which the gas to be flared travels from the source to an outside environment.

6. The system of claim 2, wherein only a portion of the gas to be flared travels through the body.

7. The system of claim 1, further comprising a pilot ignition system.

8. The system of claim 1, wherein the actuator comprises a turbine.

9. The system of claim 8, wherein the actuator comprises a first member and a second member positioned in contact with the first member such that relative motion between the first member and the second member generates sparks.

10. The system of claim 9, wherein the turbine is operably coupled to the first member such that rotation of the turbine causes relative motion between the first member and the second member.

11. The system of claim 9, wherein the first member comprises a ferrocerium alloy and the second member comprises a material harder than the first member.

12. The system of claim 9, wherein the actuator further comprises a shaft of the turbine connected to a first pulley, a second pulley in communication with the first pulley such that the rotation of the first pulley causes rotation of the second pulley, the second pulley connected to the first member.

13. A device for igniting in a flare tip, the device comprising:

a body having an inlet and an outlet, the body defining a channel extending between the inlet and the outlet;

an igniter operable to generate a spark at the outlet of the body;

an actuator disposed in the channel, the actuator configured to harvest energy when the gas to be flared flows from the inlet to the outlet through the channel and transfer the energy to the igniter, wherein the actuator comprises a turbine.

14. The device of claim 13, wherein the actuator comprises a first member and a second member positioned in contact with the first member such that relative motion between the first member and the second member generates sparks.

15. The device of claim 14, wherein the turbine is operably coupled to the first member such that rotation of the turbine causes relative motion between the first member and the second member.

* * * * *